US006619796B2

(12) United States Patent
Rasmussen et al.

(10) Patent No.: US 6,619,796 B2
(45) Date of Patent: Sep. 16, 2003

(54) STARWHEEL ACTUATION TIMING FOR PRINT MEDIA TRANSPORT SYSTEM AND METHOD

(75) Inventors: Steve O. Rasmussen, Vancouver, WA (US); Robert M. Yraceburu, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 45 days.

(21) Appl. No.: 10/016,454

(22) Filed: Oct. 30, 2001

(65) Prior Publication Data

US 2003/0081100 A1 May 1, 2003

(51) Int. Cl.[7] ..... B41S 2/01
(52) U.S. Cl. ..... 347/104; 271/273
(58) Field of Search ..... 347/104; 271/273, 271/265.01, 274; 400/636.3, 637, 637.1, 634–641

(56) References Cited

U.S. PATENT DOCUMENTS 5,368,403 A 11/1994 Broder et al.
5,420,621 A 5/1995 Richtsmeier et al.
5,738,454 A 4/1998 Zepeda et al.
5,818,487 A * 10/1998 Yoshimura ..... 347/104

* cited by examiner

*Primary Examiner*—Judy Nguyen
*Assistant Examiner*—Ly Tran

(57) ABSTRACT

A print media transport assembly for advancing a print media through a print zone includes a primary drive roller rotatably mounted on an entry side of the print zone and a pinch roller rotatably mounted opposite the primary drive roller. The primary drive roller and the pinch roller are adapted to contact the print media and the primary drive roller is adapted to advance the print media through the print zone. The print media transport assembly also includes a secondary drive roller rotatably mounted on an exit side of the print zone and a starwheel rotatably mounted opposite the secondary drive roller. The secondary drive roller is adapted to contact a first side of the print media and the starwheel is adapted to selectively contact a second side of the print media.

41 Claims, 4 Drawing Sheets

STARWHEEL ACTUATION TIMING FOR PRINT MEDIA TRANSPORT SYSTEM AND METHOD

THE FIELD OF THE INVENTION

The present invention relates generally to inkjet printers, and more particularly to engagement or actuation timing for a starwheel of a print media transport assembly in an inkjet printing system.

BACKGROUND OF THE INVENTION

A conventional inkjet printing system includes a printhead assembly, an ink supply which supplies liquid ink to the printhead assembly, and an electronic controller which controls the printhead assembly. The printhead assembly, commonly referred to as a print cartridge or pen, ejects ink drops through a plurality of orifices or nozzles and toward a print media, such as a sheet of paper, so as to print onto the print media. Typically, the orifices are arranged in one or more arrays such that properly sequenced ejection of ink from the orifices causes characters or other images to be printed upon the print media as the printhead assembly and the print media are moved relative to each other.

To move the print media relative to the printhead assembly and route the print media through a print media path, the conventional inkjet printing system includes a print media transport assembly. Typically, the print media transport assembly includes one or more rollers or wheels each rotatably mounted for contacting the print media and routing the print media through the print media path. In order to route the print media under and through a print zone between the printhead assembly and the print media and hold the print media in position during printing, the print media transport assembly often includes a number of starwheels each formed with a plurality of radially spaced tips. As such, the starwheels are positioned in opposing relationship to and contact output drive rollers such that the print media is fed into engagement between the starwheels and the output drive rollers after the ink is deposited on the print media. Thus, the starwheels and the output drive rollers are positioned on an exit side of the print zone.

Unfortunately, as the starwheels contact the print media, the starwheels may pick up the newly deposited ink and redeposit the ink on the print media thereby causing tracking on the print media. This problem becomes worse as printing speeds increase since the time between deposit of the ink on the print media and contact of the print media by the starwheels is reduced. Thus, the newly deposited ink may not have sufficient time before contact by the starwheels.

In addition, since the tips of the starwheels contact the opposing output drive rollers, surface materials of the starwheels and the output drive rollers must be compatible to prevent excess wear of the tips of the starwheels and/or the surface of the output drive rollers. For example, the starwheels are often formed of stainless steel or plastic and the output drive rollers are often formed of plastic or rubber. Forming the output drive rollers of plastic or rubber, however, does not facilitate the most accurate routing of the print media during printing thereby leading to image quality defects. Also, a bottom print margin of the print media must be sufficient to ensure that the print media is held in position on an entry side of the print zone by other rollers or wheels of the print media transport assembly other than the starwheels and the output drive rollers. Consequently, a size of the bottom print margin which is defined as a distance between rollers on the entry side of the print zone and the print zone itself limits how close printing can occur to the bottom the page. Such a limit is undesirable, for example, for duplex printing where a bottom print margin on a second side of the print media dictates the actual top print margin for that side of the print media although equal top and bottom print margins for both sides of the print media are preferred.

Accordingly, a need exists for accommodating faster printing speeds and reducing a size of a bottom print margin while using a starwheel to route a print media through a printer. In particular, a need exists for controlling actuation of a starwheel of a print media transport assembly so as to minimize tracking on the print media by the starwheel as well as minimize wear between the starwheel and an output drive roller such that the output drive roller may be formed of a suitable material to enable more accurate routing of the print media during printing.

SUMMARY OF THE INVENTION

One aspect of the present invention provides a print media transport assembly for advancing a print media through a print zone. The print media transport assembly includes a primary drive roller rotatably mounted on an entry side of the print zone and adapted to contact the print media and advance the print media through the print zone, a pinch roller rotatably mounted opposite the primary drive roller and adapted to contact the print media, a secondary drive roller rotatably mounted on an exit side of the print zone and adapted to contact a first side of the print media, and a starwheel rotatably mounted opposite the secondary drive roller and adapted to selectively contact a second side of the print media.

Another aspect of the present invention provides an inkjet printing system for printing on a print media. The inkjet printing system includes a printhead assembly adapted to eject ink drops toward a first side of the print media into a print zone between the printhead assembly and the print media to print on the print media, and a print media transport assembly adapted to route the print media through the inkjet printing system relative to the printhead assembly. The print media transport assembly includes a drive roller rotatably mounted on an exit side of the print zone and adapted to contact a second side of the print media, and a starwheel rotatably mounted opposite the drive roller and adapted to selectively contact the first side of the print media.

Another aspect of the present invention provides a method of advancing a print media through a print zone. The method includes rotatably mounting a drive roller on an exit side of the print zone, rotatably mounting a starwheel in opposing relationship to the drive roller on the exit side of the print zone, contacting a first side of the print media with the drive roller, and selectively actuating the starwheel and contacting a second side of the print media with the starwheel.

Another aspect of the present invention provides a method of printing on a print media. The method includes feeding the print media into a print zone, printing on the print media in the print zone, contacting a first side of the print media with a drive roller provided on an exit side of the print zone, and selectively actuating a starwheel provided in opposing relationship to the drive roller on the exit side of the print zone. As such, selectively actuating the starwheel includes selectively contacting a second side of the print media with the starwheel based on a position of the print media during printing.

BRIEF DESCRIPTION OF THE DRAWINGS

FIG. 4A is a schematic side view illustrating feeding of a print media into a print media transport assembly according to the present invention.

FIG. 4B is a schematic side view illustrating positioning of the print media in a print zone with the print media transport assembly of FIG. 4A with a starwheel of the print media transport assembly in a disengaged position.

FIG. 4C is a schematic side view illustrating actuation of the starwheel of FIG. 4B to an engaged position.

FIG. 4D is a schematic side view illustrating advancement of the print media through the print zone with the starwheel of FIG. 4C in the engaged position.

FIG. 4E is a schematic side view illustrating ejection of the print media from the print media transport assembly with the starwheel of FIG. 4D in the engaged position.

FIG. 4F is a schematic side view illustrating actuation of the starwheel of FIG. 4E to the disengaged position.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printing system and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
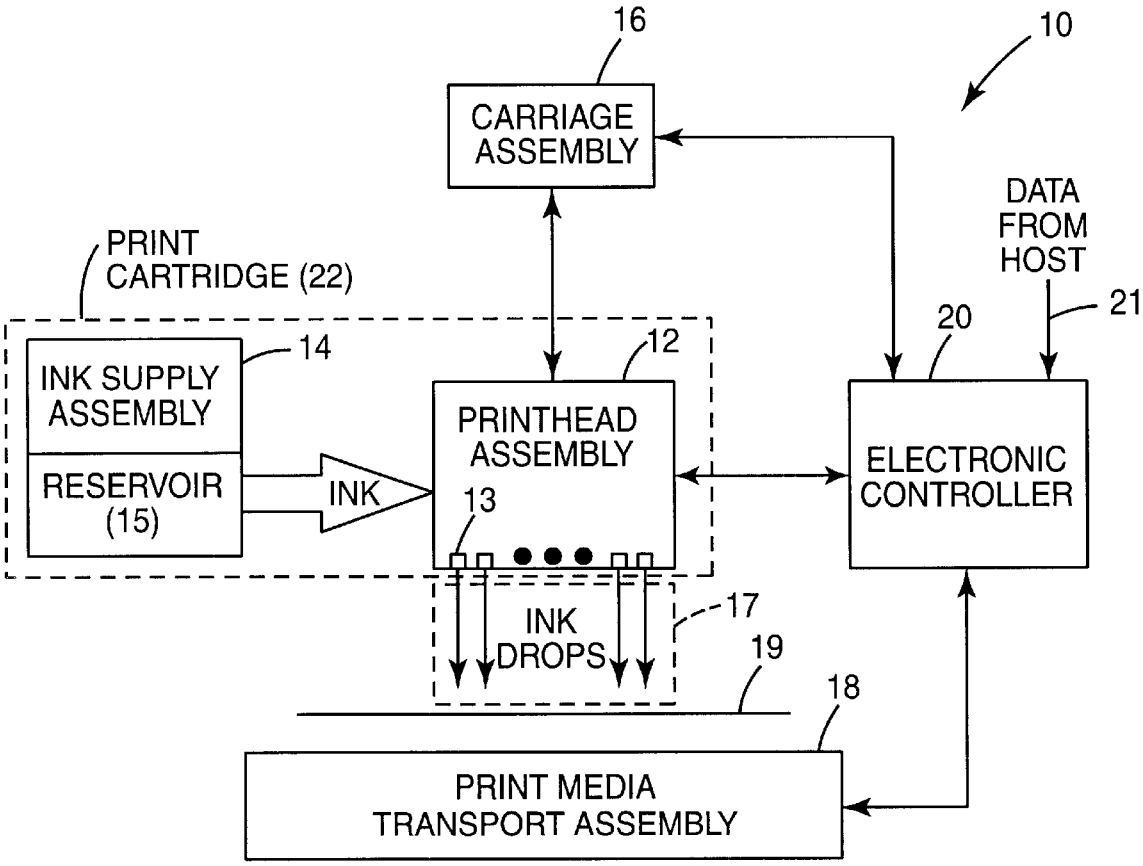
FIG. 1 is a block diagram illustrating one embodiment of an inkjet printing system according to the present invention.

FIG. 1 illustrates one embodiment of a portion of an inkjet printing system 10 according to the present invention. Inkjet printing system 10 includes an inkjet printhead assembly 12, an ink supply assembly 14, a carriage assembly 16, a print media transport assembly 18, and an electronic controller 20. Inkjet printhead assembly 12 includes one or more printheads which eject drops of ink through a plurality of orifices or nozzles 13 and toward a print media 19 so as to print onto print media 19. Print media 19 is any type of suitable sheet material, such as paper, card stock, envelopes, labels, transparencies, Mylar, and the like. Typically, nozzles 13 are arranged in one or more columns or arrays such that properly sequenced ejection of ink from nozzles 13 causes characters, symbols, and/or other graphics or images to be printed upon print media 19 as inkjet printhead assembly 12 and print media 19 are moved relative to each other.

Ink supply assembly 14 supplies ink to printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together in an inkjet print cartridge or pen, as identified by dashed line 22. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled.

Carriage assembly 16 positions inkjet printhead assembly 12 relative to print media transport assembly 18 and print media transport assembly 18 positions print media 19 relative to inkjet printhead assembly 12. As such, a print zone 17 is defined adjacent to nozzles 13 in an area between inkjet printhead assembly 12 and print media 19. Thus, print media 19 is advanced under and through print zone 17 during printing. In one embodiment, inkjet printhead assembly 12 is a scanning type printhead assembly. As such, carriage assembly 16 moves inkjet printhead assembly 12 relative to print media transport assembly 18 to scan print media 19. In another embodiment, inkjet printhead assembly 12 is a non-scanning type printhead assembly. As such, carriage assembly 16 fixes inkjet printhead assembly 12 at a prescribed position relative to print media transport assembly 18. Thus, print media transport assembly 18 positions print media 19 relative to inkjet printhead assembly 12.

Electronic controller 20 communicates with inkjet printhead assembly 12, carriage assembly 16, and print media transport assembly 18. Thus, electronic controller 20 provides control of inkjet printhead assembly 12, carriage assembly 16, and print media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
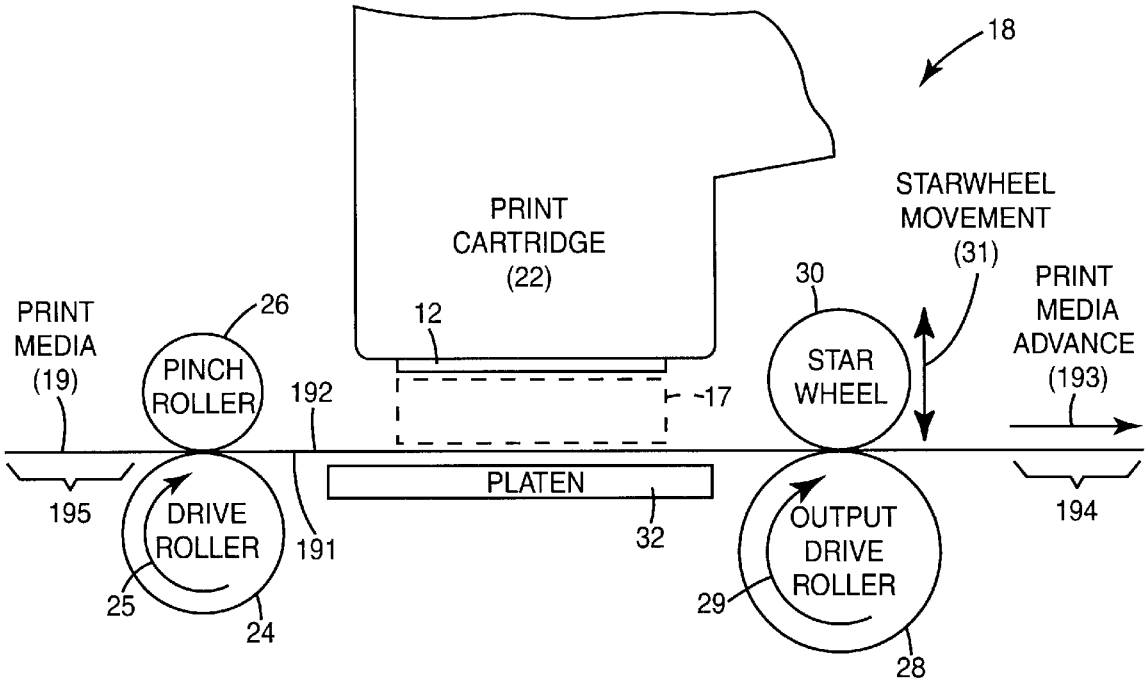
FIG. 2 is a schematic side view illustrating one embodiment of a portion of a print media transport assembly and a print cartridge according to the present invention.

FIG. 2 illustrates one embodiment of a portion of print media transport assembly 18 and print cartridge 22, including inkjet printhead assembly 12. Print media transport assembly 18 includes a drive roller 24, a pinch roller 26, an output drive roller 28, and a starwheel 30. As such, drive roller 24 constitutes a primary drive roller of print media transport assembly 18 and output drive roller 28 constitutes a secondary drive roller of print media transport assembly 18, as described below. Drive roller 24 is rotatably mounted for rotation and driven in a direction indicated by arrow 25. Pinch roller 26 is mounted in an opposing relationship to drive roller 24 such that a center of pinch roller 26 is aligned with a center of drive roller 24. As such, a nip is formed between drive roller 24 and pinch roller 26.

Output drive roller 28 is mounted for rotation and driven in a direction indicated by arrow 29. Starwheel 30 is mounted in an opposing relationship to output drive roller 28 such that a center of starwheel 30 is aligned with a center of output drive roller 28. Starwheel 30 is movable up and down relative to output drive roller 28 in a direction indicated by arrow 31. While starwheel 30 is illustrated as moving vertically, it is within the scope of the present invention for starwheel 30 to move up and/or down relative to output drive roller 28 in an arc, at an angle, or along any other path or paths. As such, starwheel 30 is actuated between a disengaged position and an engaged position (as illustrated in FIG. 2) to selectively contact print media 19. Preferably, starwheel 30 is actuated between the disengaged position and the engaged position based on a position of print media 19, as described in detail below.

Print media 19 has a side 191 and a side 192 opposite side 191. Print media 19 is oriented and inkjet printing system 10 is arranged such that print zone 17 is defined to side 192 of print media 19 between inkjet printhead assembly 12 and print media 19. As such, inkjet printhead assembly 12 prints on side 192 of print media 19. During printing, print media 19 is advanced relative to inkjet printhead assembly 12 in a direction indicated by arrow 193.

Print media 19 includes a leading portion 194 at one end of print media 19 and a trailing portion 195 at an opposite end of print media 19. Leading portion 194 constitutes the first portion of print media 19 which is fed through print zone 17 and trailing portion 195 constitutes the last portion of print media 19 which is fed through print zone 17. As such, leading portion 194 includes a top print margin of print media 19 and trailing portion 195 includes a bottom print margin of print media 19. More specifically, the top print margin of print media 19 and the bottom print margin of print media 19, each as defined by inkjet printing system 10, are provided within leading portion 194 and trailing portion 195, respectively.

Drive roller 24 and pinch roller 26 are provided on an entry side of print zone 17 and output drive roller 28 and starwheel 30 are provided on an exit side of print zone 17. In one embodiment, print media 19 is fed into engagement between drive roller 24 and pinch roller 26 by a pick roller or other print media transport roller (not shown) as is well known in the art. As such, drive roller 24 contacts side 191 of print media 19 and pinch roller 26 contacts side 192 of print media 19.

Drive roller 24 and pinch roller 26 work in conjunction to advance print media 19 into print zone 17. Once a desired portion of print media 19 reaches print zone 17, print media 19 is held in position as print cartridge 22, including inkjet printhead assembly 12, traverses print media 19 in a direction substantially perpendicular to the direction of print media advance indicated by arrow 193 (i.e., in a direction in and out of the plane of the paper) to print on print media 19 and create a print swath on side 192 of print media 19. In one embodiment, print media 19 is held against a platen 32 which is positioned in a region opposite print zone 17 adjacent to side 192 of print media 19. Once print cartridge 22 has completed the print swath, print media 19 is advanced an incremental distance in the direction of print media advance indicated by arrow 193 to permit further printing on print media 19 and the creation of an additional print swath on side 192 of print media 19.

It is understood that FIG. 2 is a simplified schematic illustration of print media transport assembly 18. For example, the relative size and spacing of drive roller 24, pinch roller 26, output drive roller 28, and starwheel 30 may vary in accordance with the present invention. In addition, an orientation of the opposing relationships of pinch roller 26 to drive roller 24 and/or starwheel 30 to output drive roller 28 may vary. More specifically, a center of pinch roller 26 and a center of starwheel 30 need not be directly above drive roller 24 and output drive roller 28, respectively. In addition, the relative alignment of drive roller 24 and pinch roller 26 to output drive roller 28 and starwheel 30 may vary. Furthermore, multiple drive rollers 24, multiple pinch rollers 26, multiple output drive rollers 28, and/or multiple starwheels 30 each spaced in a direction substantially perpendicular to the direction of print media advance indicated by arrow 193 (i.e., in a direction in and out of the plane of the paper) may form print media transport assembly 18. In addition, the spacing between inkjet printhead assembly 12 and print media 19 has been exaggerated for clarity of the invention. Furthermore, it is understood that print media 19 contacts platen 32 and that print zone 17 extends to print media 19.

Figure 3:
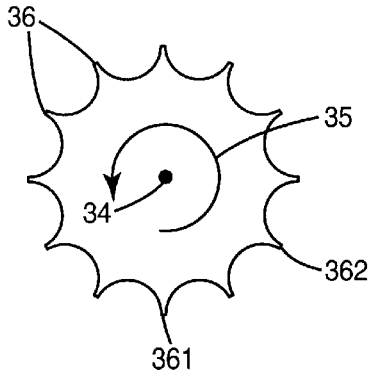
FIG. 3 is a side view illustrating one embodiment of a starwheel according to the present invention.

FIG. 3 illustrates one embodiment of starwheel 30. Starwheel 30 has a center axis 34 and includes a plurality of tips 36 spaced radially along a circumference of starwheel 30. Starwheel 30 rotates about center axis 34 in a direction indicated by arrow 35 and includes a first tip 361 and a second tip 362 spaced circumferentially from first tip 361 in the direction of rotation indicated by arrow 35. As such, first tip 361 of tips 36 forms a first contact point of starwheel 30 and second tip 362 of tips 36 forms a second contact point of starwheel 30. In one embodiment, first tip 361, second tip 362, and each tip between first tip 361 and second tip 362 each contact print media 19 only once, as described in detail below, as starwheel 30 rotates in the direction indicated by arrow 35.

FIGS. 4A–4F illustrate one embodiment of engagement or actuation timing of starwheel 30 during printing on print media 19. More specifically, starwheel 30 is moved between a disengaged position, as illustrated, for example, in FIG. 4A, and an engaged position, as illustrated, for example, in FIG. 4C, to selectively contact side 192 of print media 19.

Figure 4A:
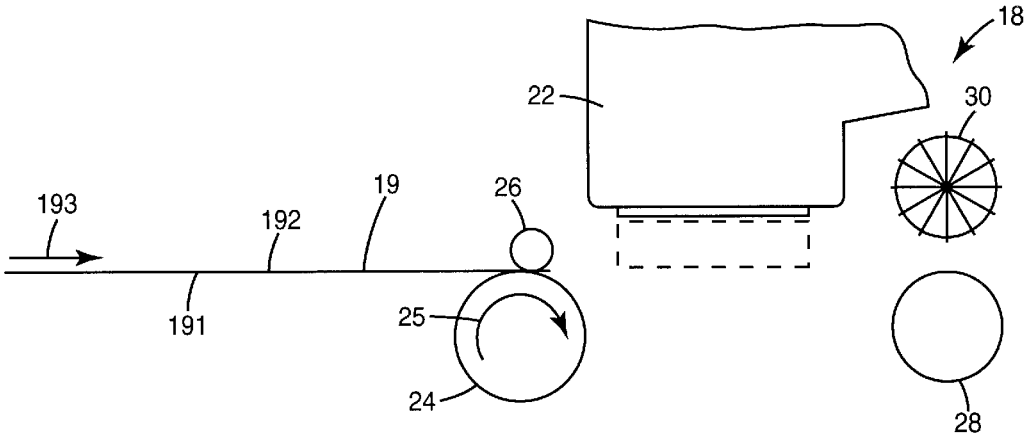
FIGS. 4A–4F illustrate one embodiment of actuation timing of a starwheel of a print media transport assembly according to the present invention.

As illustrated in FIG. 4A, print media 19 is fed into print media transport assembly 18. Print media 19 is fed into print media transport assembly 18 via a pick roller or other print media feed roller (not shown) as is well known in the art. As such, print media 19 is fed into the nip between drive roller 24 and pinch roller 26 such that drive roller 24 contacts side 191 of print media 19 and pinch roller 26 contacts side 192 of print media 19. Drive roller 24 is driven and rotated in the direction indicated by arrow 25 to advance print media 19 in the direction indicated by arrow 193. Preferably, starwheel 30 is in the disengaged position as print media 19 is fed into print media transport assembly 18.

Figure 4B:
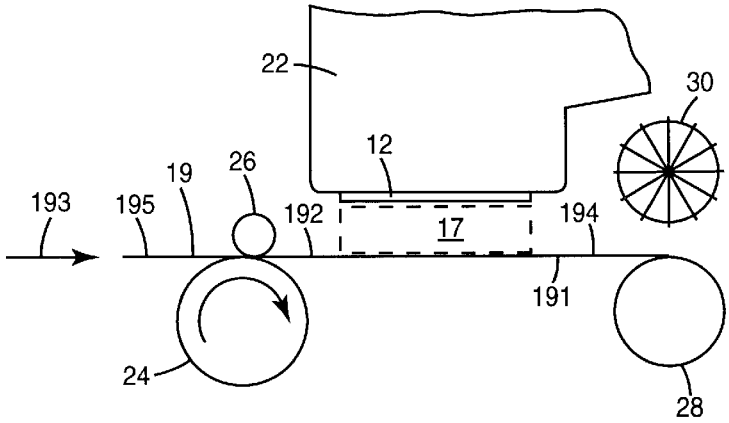

As illustrated in FIG. 4B print media 19 is positioned in print zone 17 by drive roller 24 and pinch roller 26. With print media 19 positioned in print zone 17, print cartridge 22, including inkjet printhead assembly 12, traverses print media 19 in a direction substantially perpendicular to the direction of print media advance indicated by arrow 193 (i.e., in a direction in and out of the plane of the paper). As such, inkjet printhead assembly 12 prints on print media 19 and creates a print swath on side 192 of print media 19. Thus, once inkjet printhead assembly 12 has completed the print swath, print media 19 is advanced an incremental distance in the direction of print media advance indicated by arrow 193. Thereafter, print cartridge 22, including inkjet printhead assembly 12, traverses print media 19 in the direction substantially perpendicular to the direction of print media advance indicated by arrow 193 to further print on print media 19 and create an additional print swath on side 192 of print media 19.

As leading portion 194 of print media 19 is advanced through and exits print zone 17 and prior to output drive roller 28 contacting print media 19, starwheel 30 is maintained in the disengaged position. As such, starwheel 30 is spaced from print media 19 and, therefore, does not contact print media 19 as leading portion 194 of print media 19 is advanced through and exits print zone 17. Thus, as illustrated in FIG. 4B, drive roller 24, pinch roller 26, and output drive roller 28 contact print media 19 while inkjet printhead assembly 12 prints between leading portion 194 and trailing portion 195 of print media 19.

Figure 4C:
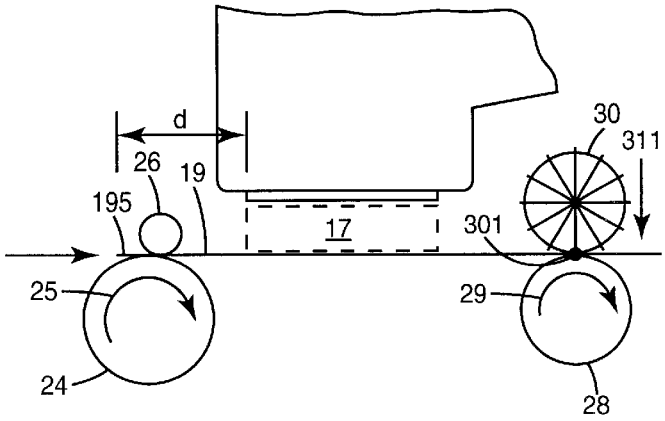

As illustrated in FIG. 4C, starwheel 30 is actuated and moved to the engaged position, as indicated by arrow 311, so as to contact print media 19 when output drive roller 28 contacts print media 19. As such, starwheel 30 only contacts print media 19 and, therefore, does not directly contact output drive roller 28. Thus, drive roller 24, pinch roller 26, output drive roller 28, and starwheel 30 contact print media 19. With drive roller 24 and output drive roller 28 both contacting print media 19, drive roller 24 is driven and rotated in the direction indicated by arrow 25 and output drive roller 28 is driven and rotated in the direction indicated by arrow 29 to advance print media 19 through print zone 17. In one embodiment, starwheel 30 is actuated and moved to the engaged position when drive roller 24 and/or pinch roller 26 contact trailing portion 195 of print media 19. As such, a tip of starwheel 30 forms an initial point of contact 301 of starwheel 30 with print media 19.

Figure 4D:
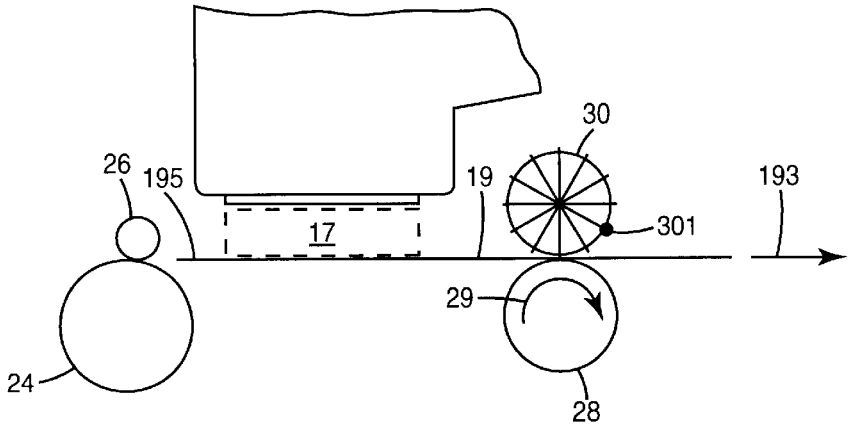

As illustrated in FIG. 4D, output drive roller 28 is driven and rotated in the direction indicated by arrow 29 to advance print media 19 in the direction of print media advance indicated by arrow 193. With trailing portion 195 of print media 19 being released from drive roller 24 and pinch roller 26, output drive roller 28 and starwheel 30 cooperate to advance print media 19 through print zone 17 as trailing portion 195 of print media 19 enters print zone 17. Thus, as trailing portion 195 of print media 19 is advanced through print zone 17, starwheel 30 is maintained in the engaged position. As such, initial point of contact 301 of starwheel 30 is rotated as print media 19 advances in the direction indicated by arrow 193. By rotation of output drive roller 28 and starwheel 30, print media 19 is advanced to a final print position in print zone 17. Preferably, a final print swath is printed on print media 19 in trailing portion 195 as print media 19 is held in position with output drive roller 28 and starwheel 30.

Figure 4E:
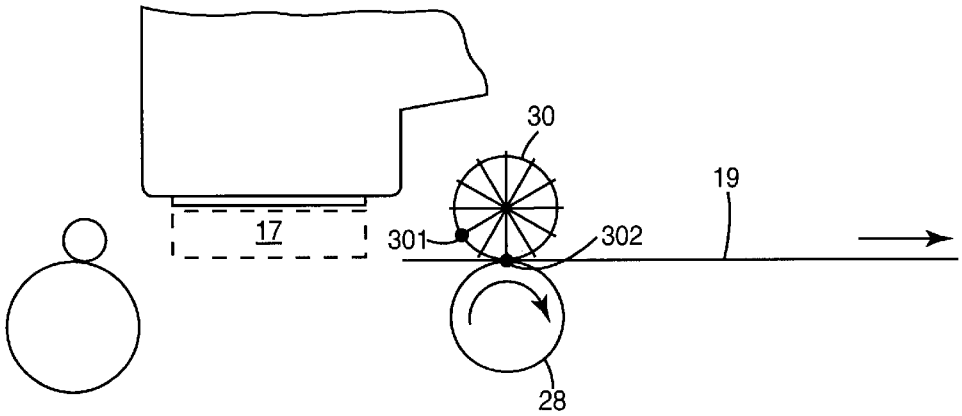

As illustrated in FIG. 4E, starwheel 30 is maintained in the engaged position and output drive roller 28 and starwheel 30 cooperate to advance print media 19 through print zone 17. As print media 19 is advanced through print zone 17, starwheel 30 contacts print media 19 between initial point of contact 301 and a final point of contact 302.

Figure 4F:
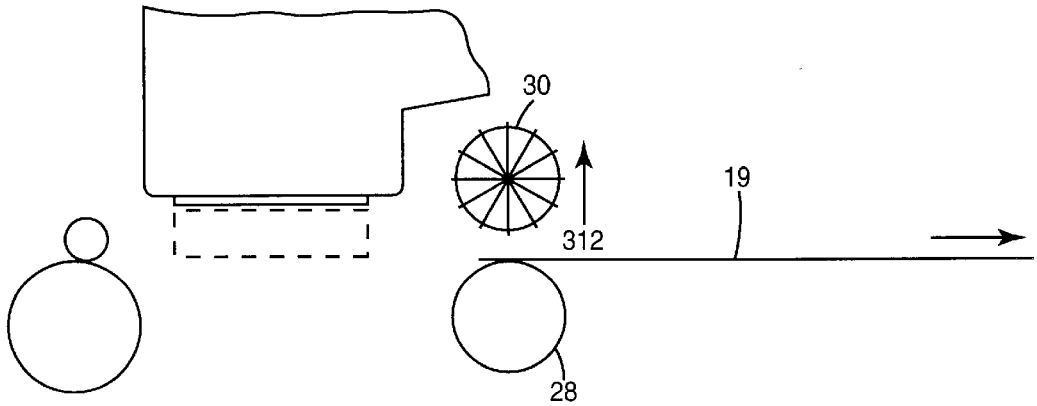

As illustrated in FIG. 4F, after printing is complete, starwheel 30 is moved to the disengaged position, as indicated by arrow 312, so as to be spaced from print media 19. Thus, starwheel 30 does not contact output drive roller 28 when print media 19 is ejected or released from output drive roller 28 and starwheel 30. It is understood that printing may be complete and, therefore, within the scope of the present invention for starwheel 30 to be moved to the disengaged position while trailing portion 195 and, more specifically, a trailing edge of print media 19 is within print zone 17. Accordingly, starwheel 30 is in or is moved to the disengaged position when trailing portion 195 of print media 19 exits print zone 17.

After being released from output drive roller 28 and starwheel 30, print media 19 is routed, for example, to an output tray or duplexer (not shown) as is well known in the art. Thereafter, another sheet of print media 19 is fed into engagement between drive roller 24 and pinch roller 26, as described above. It is understood that a first sheet of print media 19 may be advance by output drive roller 28 and starwheel 30 while a second sheet of print media 19 is being fed into engagement between drive roller 24 and pinch roller 26.

Preferably, starwheel 30 contacts print media 19 for less than one revolution of starwheel 30. For example, with reference to FIG. 3, first tip 361, second tip 362, and each tip between first tip 361 and second tip 362, in a direction opposite the direction of rotation indicated by arrow 35, contacts print media 19. First tip 361, however, does not re-contact print media 19 during advance of print media 19 through print zone 17. As such, one tip of starwheel 30 forms initial point of contact 301 of starwheel 30 with print media 19 and another tip of starwheel 30 forms final point of contact 302 of starwheel 30 with print media 19. Thus, tips 36 between first tip 361 and second tip 362, in the direction indicated by arrow 35, do not contact print media 19 and tips 36 between first tip 361 and second tip 362, in a direction opposite the direction indicated by arrow 35, do not re-contact print media 19.

In one embodiment, to ensure that initial contact point 301 of starwheel 30 does not re-contact print media 19 during advance of print media 19 through print zone 17, a circumference of starwheel 30 is selected so as to be greater than a length of trailing portion 195 of print media 19. More specifically, since starwheel 30 is moved to the engaged position and contacts print media 19 when drive roller 24 and/or pinch roller 26 contact trailing portion 195 of print media 19 (FIG. 4C), the circumference of starwheel 30 is selected so as to be greater than a final length of print media 19 between an initial point of contact on print media 19 by starwheel 30 and a trailing edge or a final move distance of print media 19 for printing. This final length, minus any desired bottom margin and/or plus any feed distance for multi-pass print modes, is indicated, for example, as distance d in FIG. 4C. As such, starwheel 30 rotates for less than one revolution to advance the final length of print media 19 through print zone 17. Thus, starwheel 30 is moved between the disengaged and the engaged position to contact print media 19 when the final length of print media 19 to be advanced through print zone 17 is less than the circumference of starwheel 30.

By selectively contacting print media 19 with starwheel 30, starwheel 30 avoids tracking on print media 19. More specifically, by controlling actuation timing of starwheel 30 such that starwheel 30 contacts print media 19 for less than one revolution of starwheel 30, an initial point of contact of starwheel 30 with print media 19 does not re-contact print media 19. As such, the possibility of picking up ink from print media 19 with the initial point of contact of starwheel 30 and redepositing the ink on the same print media 19 is avoided. In addition, if ink is picked up from print media 19 with the initial point of contact of starwheel 30 with print media 19, sufficient time should be available for the ink to dry before the initial point of contact of starwheel 30 contacts a subsequent sheet of print media 19.

By moving starwheel 30 to the engaged position only when print media 19 is between output drive roller 28 and starwheel 30, starwheel 30 only contacts print media 19 and, therefore, does not directly contact output drive roller 28. As such, output drive roller 28 may be formed with a surface typically considered incompatible with starwheel 30. More specifically, output drive roller 28 may be formed with a hardened or grit surface which is typically considered incompatible with tips 36 of starwheel 30. By forming output drive roller 28 with a grit surface, more accurate advance of print media 19 may be achieved. More specifically, print media 19 may be advanced through print zone 17 with output drive roller 28 and starwheel 30 with acceptable accuracy. Thus, by advancing print media 19 through print zone 17 with output drive roller 28 and starwheel 30, inkjet printhead assembly 12 can print in trailing portion 195 of print media 19. As such, a bottom print margin of print media 19, as included in trailing portion 195, may be reduced.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A print media transport assembly for advancing a print media having a leading portion and a trailing portion through a print zone, the print media transport assembly comprising:

a primary drive roller rotatably mounted on an entry side of the print zone and adapted to contact the print media and advance the print media through the print zone;

a pinch roller rotatably mounted opposite the primary drive roller and adapted to contact the print media;

a secondary drive roller rotatably mounted on an exit side of the print zone and adapted to contact a first side of the print media; and a starwheel rotatably mounted opposite the secondary drive roller and configured to move between a disengaged position in which the starwheel is spaced from the print media and an engaged position in which the starwheel contacts a second side of the print media, wherein the starwheel is adapted to be in the disengaged position when the leading portion of the print media exits the print zone.

2. The print media transport assembly of claim 1, wherein the primary drive roller is adapted to contact the first side of the print media and the pinch roller is adapted to contact the second side of the print media.

3. The print media transport assembly of claim 1, wherein the print zone is defined to the second side of the print media and the printer is adapted to print on the second side of the print media.

4. The print media transport assembly of claim 1, wherein the secondary drive roller is adapted to advance the print media through the print zone.

5. The print media transport assembly of claim 1, wherein the starwheel is adapted to be in the engaged position when the secondary drive roller contacts the first side of the print media.

6. The print media transport assembly of claim 1, wherein the starwheel is adapted to be in the disengaged position before the secondary drive roller contacts the leading portion of the print media.

7. The print media transport assembly of claim 1, wherein the starwheel is adapted to be in the engaged position when the primary drive roller contacts the trailing portion of the print media.

8. The print media transport assembly of claim 1, wherein the starwheel is adapted to be in the engaged position when the trailing portion of the print media enters the print zone.

9. The print media transport assembly of claim 1, wherein the starwheel is adapted to be moved to the disengaged position when the trailing portion of the print media is in the print zone.

10. The print media transport assembly of claim 1, wherein a length of the trailing portion of the print media is less than a circumference of the starwheel.

11. The print media transport assembly of claim 1, wherein the starwheel is adapted to be moved to the engaged position when a final length of the print media to be advanced through the print zone is less than a circumference of the starwheel.

12. The print media transport assembly of claim 1, wherein the starwheel is adapted to contact the print media for less than one revolution of the starwheel.

13. The print media transport assembly of claim 1, wherein the starwheel is adapted to be moved to the disengaged position when the trailing portion of the print media exits the print zone.

14. An inkjet printing system for printing on a print media having a leading portion and a trailing portion, the inkjet printing system comprising:

a printhead assembly adapted to eject ink drops toward a first side of the print media into a print zone between the printhead assembly and the print media to print on the print media; and a print media transport assembly adapted to route the print media through the inkjet printing system relative to the printhead assembly, wherein the print media transport assembly includes:

a drive roller rotatably mounted on an exit side of the print zone and adapted to contact a second side of the print media, and a starwheel rotatably mounted opposite the drive roller and configured to move between a disengaged position in which the starwheel is spaced from the print media and an engaged position in which the starwheel contacts the first side of the print media, wherein the starwheel is adapted to be in the disengaged position when the leading portion of the print media exits the print zone.

15. The inkjet printing system of claim 14, wherein the drive roller is adapted to advance the print media through the print zone.

16. The inkjet printing system of claim 14, wherein the starwheel is adapted to be in the engaged position when the drive roller contacts the second side of the print media.

17. The inkjet printing system of claim 14, wherein the starwheel is adapted lobe in the disengaged position before the drive roller contacts the leading portion of the print media.

18. The inkjet printing system of claim 14, wherein the starwheel is adapted to be in the engaged position when the trailing portion of the print media enters the print zone.

19. The inkjet printing system of claim 14, wherein the starwheel is adapted to be moved to the disengaged position when the trailing portion of the print media is in the print zone.

20. The inkjet printing system of claim 14, wherein a length of the trailing portion of the print media is less than a circumference of the starwheel.

21. The inkjet printing system of claim 14, wherein the starwheel is adapted to be moved to the disengaged position when printing is complete.

22. The inkjet printing system of claim 14, wherein the starwheel is adapted to be moved to the engaged position when a final length of the print media to be advanced through the print zone is less than a circumference of the starwheel.

23. The inkjet printing system of claim 22, wherein the starwheel is adapted to contact the media less revolution of the starwheel.

24. The inkjet printing system of claim 14, wherein the starwheel is adapted to be moved to the engaged position after the leading portion of the print media exits the print zone.

25. The inkjet printing system of claim 14, wherein the starwheel is adapted to be moved to the disengaged position when the trailing portion of the print media exits the print zone.

26. A method of advancing a print media having a leading portion and a trailing portion through a print zone, the method comprising:

rotatably mounting a drive roller on an exit side of the print zone;

rotatably mounting a starwheel in opposing relationship to the drive roller on the exit side of the print zone;

contacting a first side of the print media with the drive roller; and selectively actuating the starwheel and moving the starwheel between a first position in which the starwheel is spaced from the print media and a second position in which the starwheel contacts a second side of the print media, including providing the starwheel in the first position when the leading portion of the print media exits the print zone.

27. The method of claim 26, wherein contacting the first side of the print media with the drive roller and contacting the second side of the print media with the starwheel includes advancing the print media through the print zone with the drive roller and the starwheel.

28. The method of claim 26, wherein selectively actuating the starwheel includes providing the starwheel in the first position before contacting the first side of the print media with the drive roller.

29. The method of claim 26, wherein selectively actuating the starwheel includes moving the starwheel to the second position when the trailing portion of the print media enters the print zone and maintaining the starwheel in the second position as the railing portion moves through the print zone.

30. The method of claim 26, wherein selectively actuating the starwheel includes moving the starwheel to the first position when the trailing portion of the print media is in the print zone.

31. The method of claim 26, wherein a length of the trailing portion of the print media is less than a circumference of the starwheel.

32. The method of claim 26, wherein selectively actuating the starwheel includes moving the starwheel to the second position when a final length of the print media to be advanced through the print zone is less than a circumference of the starwheel.

33. The method of claim 26, wherein contacting the second side of the print media with the starwheel includes contacting the print media with the starwheel for less than one revolution of the starwheel.

34. The method of claim 26, wherein selectively actuating the starwheel includes moving the starwheel to the second position after the leading portion of the print media exits the print zone.

35. The method of claim 26, wherein selectively actuating the starwheel includes moving the starwheel to the second position after the trailing portion of the print media exits the print zone.

36. A method of printing on a print media, the method comprising:

feeding the print media into a print zone;

printing on a first side of the print media in the print zone;

advancing the print media through the print zone;

contacting a second side of the print media with a drive roller provided on an exit side of the print zone; and selectively actuating a starwheel provided in opposing relationship to the drive roller on the exit side of the print zone, including providing the starwheel in a first position in which the starwheel is spaced from the print media and moving the starwheel to a second position in which the starwheel contacts the first side of the print media while advancing the print media through the print zone.

37. The method of claim 36, wherein selectively actuating the starwheel includes providing the starwheel in the first position while feeding the print media into the print zone.

38. The method of claim 36, wherein selectively actuating the starwheel includes moving the starwheel to the first position when printing on the print media is complete.

39. The method of claim 36, wherein moving the starwheel to the second position includes moving the starwheel to the second position when advancing a final length of the print media through the print zone, wherein the final length of the print media is less than a circumference of the starwheel.

40. The method of claim 36, wherein selectively contacting the first side of the print media with the starwheel includes contacting the print media wit the starwheel for less than one revolution of the starwheel.

41. The print media transport assembly of claim 1, wherein the starwheel is adapted to be moved to the engaged position after the leading portion of the print media exits the print zone.

* * * * *

UNITED STATES PATENT AND TRADEMARK OFFICE

CERTIFICATE OF CORRECTION

PATENT NO. : 6,619,796 B2 
DATED : September 16, 2003
INVENTOR(S) : Steve O. Rasmussen et al.

It is certified that error appears in the above-identified patent and that said Letters Patent is hereby corrected as shown below:

Column 10,
Line 55, delete “lobe” and insert therefor -- to be --

Column 11,
Line 10, after “media” insert -- for --
Line 10, after “less” insert -- than --
Line 50, delete “railing” and insert therefor -- trailing --

Column 12,
Line 50, delete “wit” and insert therefor -- with --
Line 16, delete “second” and insert therefor -- first --
Line 17, delete “after” and insert therefor -- when --

Signed and Sealed this

First Day of February, 2005

JON W. DUDAS
*Director of the United States Patent and Trademark Office*